US005464123A

United States Patent [19]

Scarrow

[11] Patent Number: 5,464,123

[45] Date of Patent: Nov. 7, 1995

[54] VIAL CONNECTOR SYSTEM

[75] Inventor: David Scarrow, Norton St Philip, Great Britain

[73] Assignee: DRG Medical Packaging Supplies Limited, Bristol, United Kingdom

[21] Appl. No.: 193,037

[22] PCT Filed: Jun. 4, 1993

[86] PCT No.: PCT/GB93/01193

§ 371 Date: Jun. 9, 1994

§ 102(e) Date: Jun. 9, 1994

[87] PCT Pub. No.: WO93/24095

PCT Pub. Date: Dec. 9, 1993

[30] Foreign Application Priority Data

Jun. 4, 1992 [GB] United Kingdom ..... 9211912

[51] Int. Cl.[6] ..... B67D 5/00

[52] U.S. Cl. ..... 222/83.5; 222/89; 604/240

[58] Field of Search ..... 222/81, 83, 83.5, 222/88, 86, 570, 566, 153, 89, 153.09, 153.01, 153.1; 604/244, 240, 201–206; 215/317, 321, 333, 337, 340, 339

[56] References Cited

U.S. PATENT DOCUMENTS

| | | | |
|---|---|---|---|
| 2,158,593 | 5/1939 | Scrimgeour | 604/202 |
| 3,154,227 | 10/1964 | Anderson et al. | 222/570 X |
| 3,330,449 | 7/1967 | Bloomfield et al. | 222/570 X |
| 4,296,786 | 10/1981 | Brignola | 222/83.5 X |
| 4,624,393 | 11/1986 | Lopez | 222/83.5 |

FOREIGN PATENT DOCUMENTS

| | | |
|---|---|---|
| 0285424 | 10/1988 | European Pat. Off. . |
| 0367549 | 5/1990 | European Pat. Off. . |
| 2560049 | 2/1985 | France . |
| 2749045 | 6/1978 | Germany . |

*Primary Examiner*—Kevin P. Shaver
*Attorney, Agent, or Firm*—Larson and Taylor

[57] ABSTRACT

A vial connector has a circular array of detents that snap-engage behind the head of a vial to prevent its withdrawal. In a unitary injection molding, the detents could not lock completely or the product could not be removed from the mold. Therefore the connector employs independently displaceable detent elements (40), with independent resilient urging mechanism (42).

10 Claims, 2 Drawing Sheets

VIAL CONNECTOR SYSTEM

The present invention relates to a vial connector system, namely to a system for use in bringing the interior of a vial into fluid flow communication with a conduit.

Particularly in the medical field, many substances are packaged in vials, to maintain their integrity and cleanliness. This is particularly important for medicaments for administration and substances for addition to blood or plasma for eventual administration. It is frequently desirable to have a system that ensures that once a vial is connected to a conduit generally leading to a bag of fluid, disconnection is impossible or very difficult. Thus a medical worker can be confident that once the correct vial has been connected, in clean and sterile conditions, it cannot then be removed, giving a risk of contamination and possible replacement by an incorrect vial.

A standard vial has a body, a narrow neck, and an enlarged head closed by a pierceable closure. The enlarged head generally includes collar means for retaining the closure. The head has a rearwardly pointing shoulder.

Examples of vial connectors are disclosed in U.S. Pat. No. 4,675,020 and EP-A-285,424. A simple connector may have a circular base, a tubular spike passing through the centre of the base, and an annular array of detent members surrounding the spike. Each detent member comprises a wall portion and a radially inner projection. The dimensions are such that a vial can be pushed onto the spike and, as the spike penetrates the closure thereof, the head of the vial pushes past the detents. The wall portions flex outwards slightly to allow this, and then snap-engage behind the shoulder to lock the vial in place. To prevent the direct application of force to the detent members to facilitate removal of the vial, there may be a further annular wall surrounding them.

Nevertheless, such a connector cannot be fully reliable. As a practical matter, the array of detent members and the base will be formed by a moulding technique. Since it must be possible to withdraw the mould components from the formed article, the detent teeth cannot be formed so as to grip the vial head irreversibly. FIG. 1 shows an example of this type of connector, taken from EP-A-285,424. A single moulded unit provides the circular base 10, the circular array of detent elements 12 and an outer annular wall 14. The detent elements 12 each have a head 16 which, in profile, has a tapering upper surface 18 and a relatively abrupt lower surface 20. This is so that a vial can be pushed in relatively easily, but resists withdrawal. Nevertheless, for reasons explained above, the lower surfaces 20 cannot be formed without any taper. Therefore EP-A-285,424 teaches the provision of further means for locking a vial in place, namely a retainer that engages over the vial, e.g. engaging in ratchet teeth 22 provided in the outer wall 14.

Broadly, the present invention concerns a vial connector that includes a plurality of circumferentially arranged detent elements for engaging a vial, the elements being separately formed and resiliently urged independently of any encircling array of detent means as shown in FIG. 1.

In a preferred form, the invention provides a vial connector for use in bringing the interior of a vial into fluid flow communication with a conduit, said connector comprising: a base portion; a tubular spike projecting from said base portion; means defining an encircling wall projecting from the base portion so as to substantially encircle the spike; a plurality of detent elements circumferentially distributed in relation to the wall means and formed separately from the wall means; and resilient means formed separately from the wall means and arranged to urge the detent elements radially inwardly of the wall means; so that a vial having an enlarged head with a mouth closed by a pierceable closure can be engaged with the connector by urging the closure against the spike so that the spike pierces the closure and the detent elements engage behind the head to resist disengagement of the vial.

The encircling wall means may comprise a ring (or "crown") of resilient teeth members have tooth detent portions for engaging behind the vial's head. The detent elements may project inwardly between adjacent teeth. There may be an outer wall surrounding the abovementioned wall means, and the resilient means may engage the outer wall. Thus there may be individual engagement elements each providing a detent element and a resilient means, having the form of a base portion and a tooth portion projecting outwardly of the base portion, the base portion being of resilient material and dimensioned so that it is resiliently deformed when the element is located between the outer wall and the ring of resilient teeth members. The plurality of detent elements may be provided by an annular detent assembly (which may be a unitary moulding) having a base ring for encircling the encircling wall. It will generally be intended to rest on the base portion. A plurality of arms extend upwardly from the base ring, and each carries a respective engagement element which provides a detent element and a resilient means. In a preferred form, the vial connector is assembled from three separately-produced components, which provide (i) the base portion (and generally an outer wall); (ii) a ring or crown of resilient teeth members forming said encircling wall; and (iii) an annular detent assembly. Component (ii) may also have a base wall portion and a tubular spike extending therethrough. The base portion (component II) may then have an aperture through which the spike or an associated conduit projects.

Some embodiments of the invention will now be described in more detail with reference to the accompanying drawings in which.

Figure 1:
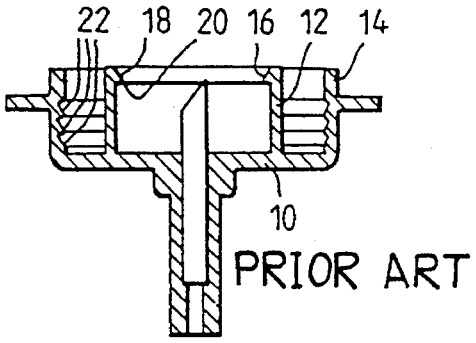
FIG. 1 shows a connector as disclosed in EP-A-285,424.
Figure 2:
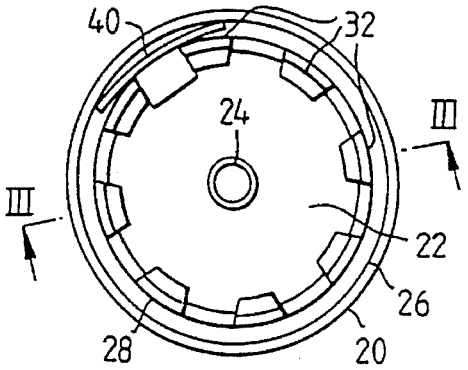
FIG. 2 is a plan view of a connector embodying the present invention.
Figure 3:
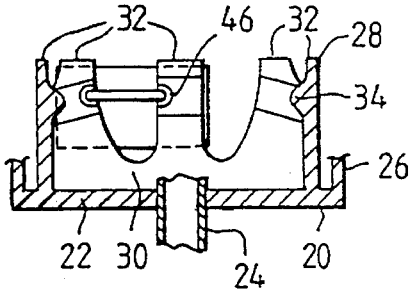
FIG. 3 is a sectional view on III—III in FIG. 2 (with some parts omitted for clarity)

FIGS. 2 and 3 show part of a connector that in many ways resembles that shown in FIG. 1. Thus there is a plastics moulding 20 which provides a circular base 22 penetrated centrally by a tubular spike 24. An outer annular wall 26 and an inner annular wall 28 are integral with the base. The inner wall 28 has the form of a crown, with a lower ring portion 30 from which individual columns 32 arise, to a uniform height which is not above (and may be substantially below) the height of the outer ring 26. Each column has, at an intermediate region, an inwardly projecting detent projection 34. Thus, as with the FIG. 1 connector, it is possible to engage a vial by pushing it into the cup defined by the inner wall 28 and the base 22, so that the spike 24 is forced through the stopper of the vial, as the head of the vial moves past the detent projections 34, until these projections snap-engage behind the head, assisted by the resilience of the columns. They then resist withdrawal of the vial. Because the projections 34 inevitably have some curvature on their undersides, if the vial is pulled outwardly, the columns 28 tend to be cammed outwardly, allowing the vial to be withdrawn.

Figure 4:
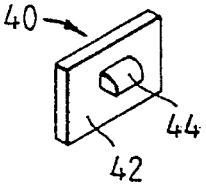
FIG. 4 is a perspective view of a detent element.
Figure 5:
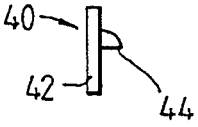
FIG. 5 is a side elevation of the detent element.

To provide further resistance to removal of a vial, additional detent elements 40 are provided. As can be seen from FIGS. 4 and 5, a detent element 40 is a unitary plastics element having a resilient plate portion 42 and a detent projection 44. In profile this has an upper surface that is shaped to allow relatively easy passage of an object (such as a vial head) downwardly. But the undersurface is abrupt, substantially right-angled as shown or even undercut. Thus an object urged upwardly will tend to be retained by the detent projection 44, whose shape does not provide any camming action to urge it out of the way.

As compared with the connector in FIG. 1, the connector shown in FIGS. 2 and 3 has the outer wall 26 more closely spaced from the inner wall 28. The spacing is such that, to accommodate a detent element 40, the plate 42 must be slightly resiliently bent. Thus, in the orientation shown in FIG. 2, the inherent resilience of the plate 42 urges the detent protection 44 radially inwardly. In the examples shown, the width of the detent projection 44 is slightly greater than the spacing of the columns 28. Thus a pair of adjacent columns 28 have notches 46 to accommodate end portions of the projection 44. Although only one element 40 is shown in FIGS. 2 and 3, there will in fact be a plurality of them, suitably 4, disposed symmetrically around the device. Thus, when a vial is engaged with the connector as described, both the detents 32 of the inner wall and the detents 44 of the elements can move outwardly to allow the head to pass into engagement. If, subsequently, an attempt is made to withdraw the vial, the columns 28 may tend to flex outwardly, but the detents 44 of the elements 40, being mounted independently and resiliently urged inwardly independently, are unaffected and keep a reliable grip on the head of the vial.

Figure 10:
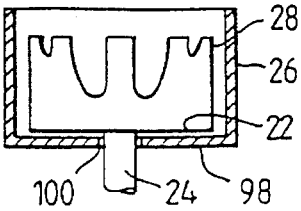
FIG. 10 is a schematic side view of elements of a further embodiment, partly in section.

Although we have described the base 22 and the two annular walls 26,28 as an integral unit, it can then be difficult to insert the detent elements 40. This is easier if, as shown in FIG. 10, the outer wall 26 is separately formed. Thus it may be moulded on a lower base 98 with a central aperture 100. Thus the elements 40 can be mounted on the inner unit (comprising the inner wall 28, the base 22 and the spike 24), and this can then be passed into the outer wall 26 so that the spike projects through the aperture 100. The lower base 98 may then be welded to the base 22 of the inner unit.

Figure 11:
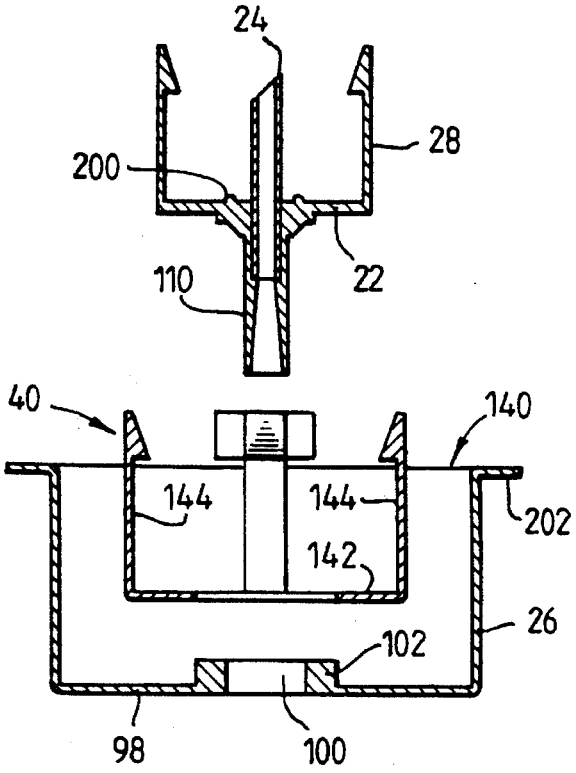
FIG. 11 is an exploded view, in axial section, of a further embodiment having three coaxial components: a crown; an annular detent assembly; and a base portion/outer wall.
Figure 12:
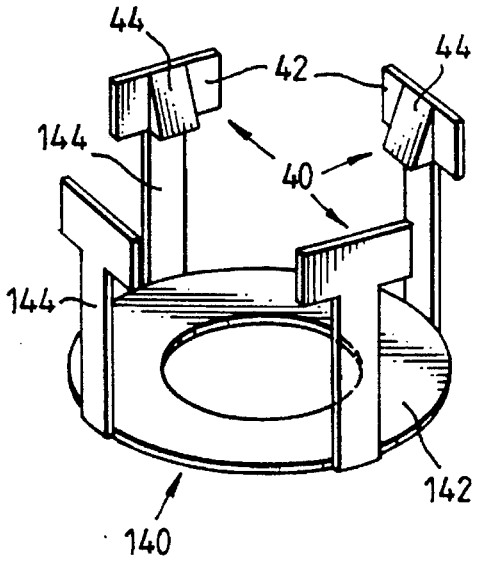
FIG. 12 is a perspective view on a larger scale of the annular detent assembly shown in FIG. 11.

A further variant is shown in FIGS. 11 and 12. Once again there are a base/outer wall component 26,98 with a central aperture 100, and an inner 'crown' unit 28,22,24. The aperture 100 is surrounded by an upstanding boss 102.

The detent elements 40 are now provided by an annular detent assembly 140 having a base ring 142 from which a plurality (here 4) of arms 144 rise. At their free ends, the arms carry the detent elements 40, each of which has a plate portion 42 and a detent projection 44. The components are dimensioned so that they fit together with the ring 142 of the detent assembly 140 embracing the boss 102, and with the conduit 110 associated with the spike 24 projecting beneath the lower base 98. The detent plate portions 40 are resiliently bent by installation between the crown 28 and the outer annular wall 26, so that the detent projections 44 are urged radially inwardly, generally as described in connection with FIG. 2. The parts may be secured together by solvent welding or ultrasonic welding. The detent assembly 140 may be formed by injection moulding. To permit separation of the mould tool the arms 144 may flex resiliently outwardly to a small extent. (They are inherently more flexible than the columns 32 of the crown 28.) However once the vial connector is fully assembled and a vial is engaged, flexing of the arm is almost impossible because of the engagement of the plate portions 40 with the outer wall 26.

Figure 6:
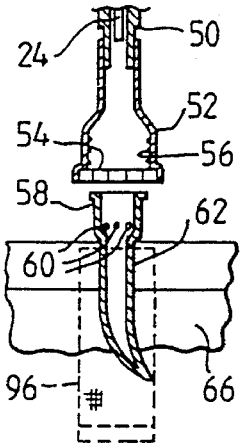
FIGS. 6–9 show examples of further components that may be coupled to or integral with the tubular spike of the embodiment.

The end of the tubular spike 24 that projects into the cup defined by the annular walls 26,28 has a sharp spike end, adapted to be forced through a rubber septum. The other end of the spike projects from the other side of the base 22 and may be coupled or coupleable to various components. FIGS. 6–9 show some possibilities, already described in more detail in our application EP-A-284,424. Thus FIG. 6 shows that the spike 24 leads to a conduit 50 that leads to a socket 52 having ratchet 54 and a thread 56 so that it may be coupled permanently to a further component. In this example this further component has Luer formations 58 for engaging the thread, and ratchet teeth 60 for engaging the ratchet formations 54; and a frangible spike 62 that extends into a sterile fluid container 66.

Figure 7:
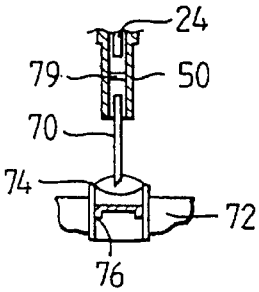

FIG. 7 also shows the spike 24 leading to a conduit 50, but this carries a further spike 70 by which it can be coupled to a further fluid container shown schematically at 72, by pushing the spike 70 through an administration port 74 closed by a penetrable septum 76.

Figure 8:
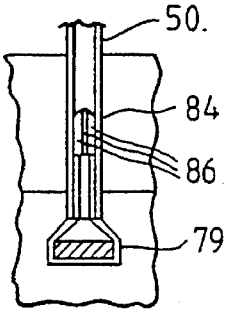

FIG. 8 shows the conduit 50 having an internal breakable barrier 84. This is of known type, employing axial vanes 86. (Another possible type is disclosed in WO91/11152.) Downstream there is a porous disc filter 79. Desirably there will also be a breakable barrier in the FIG. 7 embodiment as schematically shown at 79.

Figure 9:
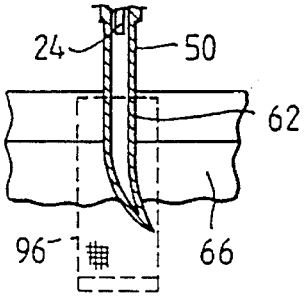

FIG. 9 resembles FIG. 6, but shows the conduit 50 leading directly to the frangible spike 62 within the fluid bag 66. The frangible end portion is shown as enclosed in a mesh container 96, to catch any particulate material that may be generated by the breaking of the spike. It could also serve to filter out undissolved particles of material from the vial.

A feature shown in FIG. 11 that may be applied to the other embodiments and, indeed, more widely (e.g. to vial connectors as disclosed in EP-A-285424) is the small upstanding annular rib 200 in the base wall 22, closely spaced from the spike 24. This is arranged so that, when vial is engaged, the rib 200 engages the rubber septum. Generally the engagement of the vial will mean that it is positively urged against the rib 200. This provides a further seal between the vial interior and the outside world. Additionally the depth to which the rib (which may offer a narrow, blade-like upper edge) is pushed into the septum may provide some accommodation of manufacturing tolerances of vials.

Figure 13:
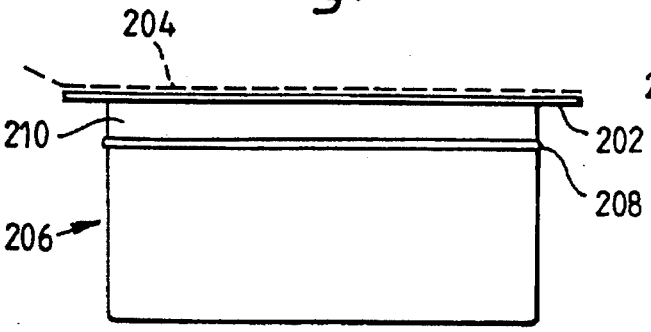
FIG. 13 is a side view of a modified base portion/outer wall component.

Another widely applicable feature of FIG. 11 is the out-turned flange 202 at the top of the outer wall 26. This allows securement of a peelable seal 204 (as shown in FIG. 13).

Figure 14:
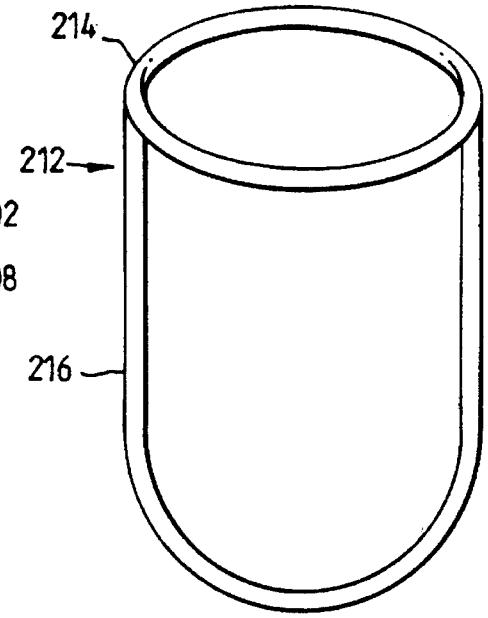
FIG. 14 is a perspective view of a hanging strap.

Typically, in use a vial will be connected with a dispensing bag of fluid via a connector embodying the invention, and it will be desired to deliver the bag's contents to a patient. It is desirable to be able to suspend the ensemble, with the vial inverted so that fluid will not be trapped in it. To facilitate this the connector system may include a hanging strap. FIG. 13 shows a base/outer wall component 206 modified for this end. It differs from that shown in FIG. 11 essentially only in having a minor out-turned flange 208 slightly below the top flange 202 so as to define a retaining groove 210. A hanger unit 212 (FIG. 14) has a resilient loop 214 that can be stretched and engaged in the groove 210, and an integral hanging strap loop 216 that will tend to extend downwardly so as not to obstruct the mouth of the connector, but which can easily be swung up for use.

I claim:

1. A vial connector for use in bringing the interior of a vial into fluid flow communication with a conduit, said connector comprising: a base portion; a tubular spike projecting from said base portion; means defining an encircling wall projecting from the base portion so as to substantially encircle the spike; a plurality of detent elements circumferentially distributed in relation to the wall means and formed separately from the wall means; and resilient means formed separately from the wall means and arranged to urge the detent elements radially inwardly of the wall means, so that a vial having an enlarged head with a mouth closed by a pierceable closure can be engaged with the connector by urging the closure against the spike so that the spike pierces the closure and the detent elements engage behind the head to resist disengagement of the vial.

2. A connector according to claim 1 wherein the encircling wall means comprise a ring of resilient teeth members having tooth detent portions for engaging behind the vial's head.

3. A connector according to claim 2 wherein the detent elements project inwardly between adjacent teeth.

4. A connector according to claim 1 including an outer wall surrounding said encircling wall means; and wherein the resilient means engage the outer wall.

5. A connector according to claim 4 wherein said detent elements and said resilient means are provided by a plurality of individual engagement elements each providing one said detent element and one said resilient means, each individual engagement element having the form of a base portion and a tooth portion projecting outwardly of the base portion, the tooth portion constituting said one detent element, and the base portion being of resilient material and dimensioned so that said base portion is resiliently deformed when the element is located between the outer wall and the ring of resilient teeth members, whereby the base portion constitutes said one resilient means.

6. A connector according to claim 4 wherein the vial connector is assembled from three separately-produced components, which provide (i) the base portion and said outer wall; (ii) a ring of resilient teeth members forming said encircling wall; and (iii) an annular detent assembly which provides said plurality of detent elements and said resilient means.

7. A connector according to claim 1 wherein the vial connector is assembled from three separately-produced components, which provide (i) the base portion; (ii) a ring of resilient teeth members forming said encircling wall; and (iii) an annular detent assembly which provides said plurality of detent elements and said resilient means.

8. A connector according to claim 8 wherein said ring of resilient teeth members forming said encircling wall has a base wall portion with said tubular spike extending therethrough.

9. A connector according to claim 1 wherein said plurality of detent elements and said resilient means are provided by an annular detent assembly having a base ring for encircling the encircling wall, and a plurality of arms extending upwardly from the base ring, each of which said arms carries a respective engagement element which provides one of said detent elements and one of said resilient means.

10. A connector according to claim 9 wherein said annular detent assembly is a unitary molding.

* * * * *